US010041322B2

(12) United States Patent
Braddick

(10) Patent No.: US 10,041,322 B2
(45) Date of Patent: Aug. 7, 2018

(54) GRIPPING TOOL FOR REMOVING A SECTION OF CASING FROM A WELL

(71) Applicant: TIW Corporation, Houston, TX (US)

(72) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 159 days.

(21) Appl. No.: 14/930,182

(22) Filed: Nov. 2, 2015

(65) Prior Publication Data

US 2017/0122053 A1 May 4, 2017

(51) Int. Cl.

| | |
|---|---|
| ***E21B 23/01*** | (2006.01) |
| ***E21B 29/00*** | (2006.01) |
| ***E21B 31/20*** | (2006.01) |
| *E21B 33/13* | (2006.01) |

(52) U.S. Cl.

CPC ..... *E21B 31/20* (2013.01); *E21B 23/01* (2013.01); *E21B 29/00* (2013.01); *E21B 29/005* (2013.01); *E21B 33/13* (2013.01)

(58) Field of Classification Search

CPC ..... E21B 23/01; E21B 29/005; E21B 31/20; E21B 33/13

See application file for complete search history.

(56) References Cited

U.S. PATENT DOCUMENTS 2,934,147 A * 4/1960 Baker ..... E21B 29/00 166/298
6,357,528 B1 * 3/2002 Davis ..... E21B 29/005 166/298
6,629,565 B2 * 10/2003 Harrell ..... E21B 29/005 166/178
8,869,896 B2 * 10/2014 Crow ..... E21B 31/20 166/298
8,881,818 B2 * 11/2014 Crow ..... E21B 23/01 166/298
8,881,819 B2 * 11/2014 Crow ..... E21B 23/01 166/298
2013/0048268 A1 2/2013 Crow et al.

FOREIGN PATENT DOCUMENTS

WO 2011031164 A1 3/2011

OTHER PUBLICATIONS

International Search Report and Written Opinion issued in related PCT application No. PCT/US2016/059892 dated Jan. 31, 2017, 12 pages.

International Preliminary Report on Patentability issued in related PCT application No. PCT/US2016/059892, dated May 17, 2018, 8 pages.

* cited by examiner

*Primary Examiner* — Matthew R Buck
(74) *Attorney, Agent, or Firm* — Baker Botts L.L.P.

(57) ABSTRACT

A gripping tool having a mandrel reciprocatable within a slide member, the mandrel having a top connector for connecting to a tubular string and a bottom connector for connecting to a cutting tool, the slide member having at least one radially outwardly biased friction member and a slip cage with at least one window through which a slip is deployable, by movement of the mandrel within the slide member, to engage and grip a section of casing to be removed from a well, the mandrel being rotatable by rotation of the tubular string to operate the cutting tool with the gripping tool in the gripping mode. After detachment of the section of casing by the cutting tool, the gripping tool and the gripped section of casing are pulled from the well. The gripping mode is restorable to a running position to reset the tool in the casing.

12 Claims, 11 Drawing Sheets

GRIPPING TOOL FOR REMOVING A SECTION OF CASING FROM A WELL

BACKGROUND

Field of the Invention

The present invention relates to the recovery of a section of casing pipe from a well that has been cased with the casing pipe. The present invention relates to a method and a tool for the use in the recovery of a section of casing to prepare the well for plugging and abandoning the well or for recovering a slot in a template on a seafloor used for drilling multiple wells for recovering hydrocarbons.

Background of the Related Art

Earthen wells are drilled into the earth's crust to provide access to geologic formations bearing hydrocarbons. Tubulars can be run into the drilled well to provide a fluid conduit for the recovery to the earth's surface of minerals such as, for example, oil or gas, from subsurface geologic formations. Earthen wells may also be drilled to provide a fluid conduit for disposal of waste fluids or for the maintenance of pressure in a mineral bearing reservoir by injection of fluids through the well and into the reservoir.

After a well is drilled, it is generally cased with a string of casing, which are tubular joints joined at the ends to provide a casing string. The casing string is generally cemented in place within the drilled well. After the well has served its intended purpose, it is usually plugged and abandoned. Plugging and abandonment involves the removal from the well of at least a section of the casing string, followed by the plugging of the well using a cement plug. This type of plugging and abandonment prevents unwanted cross-flow between geologic formations and zones that are penetrated by the well.

In some offshore fields, subsea templates are constructed on the seafloor to provide a plurality of slots from which wells can be drilled to access a subsurface geologic formation bearing hydrocarbons. A slot in the template may become inactive if the well has structural problems or if the geologic formation in which the well is perforated becomes watered out or otherwise unproductive. It is advantageous to recover the slot for use in drilling a new well to a different geologic formation or to a different portion of the same geologic formation.

An effective placement of a cement plug to abandon a well in a manner that prevents unwanted cross-flow of penetrated geologic formations requires the removal of a section of casing from the well. A volume of a cement slurry can then be pumped into the portion of the well from which the casing is removed and pressurized to promote cement bonding as the cement slurry sets. Some conventional methods and tools use a marine swivel having a large mass for being supported on a wellhead or on a slot of a seafloor template. The marine swivel includes a mandrel extending into the well from the marine swivel that rotates a cutting tool to cut the casing. The mandrel is rotated by rotation of a tubular string extended through a riser from a platform or rig. Once the cutting tool successfully cuts the casing at a targeted location, the marine swivel is removed and the cutting tool is retrieved. A gripping tool coupled to a tubular string is then run into the well and deployed to grip a section of the casing above the location of the cut. Withdrawal of the tubular string retrieves the gripping tool and the gripped section of casing from the well.

A shortcoming of the conventional methods and tools used for removing a section of casing from a well for plug and abandonment or slot recovery arises from the need to withdraw the cutting tool from the well so that a casing gripping tool can be run into the well to grip and retrieve the section of casing. This process, which includes at least two trips with two different tools on the tubular string, requires a large amount of rig time.

Another shortcoming of conventional methods and apparatus used for removing a section of casing from a well arises from the inability to easily and conveniently reset the location of the cutting tool. The marine swivel is supported on the wellhead or seafloor template, and the distance between the marine swivel and the cutting tool supported from the marine swivel is not variable or adjustable. In the event that the cutting tool gets hung up or jammed, or if the first attempt to cut the casing is unsuccessful, the position of the cutting tool in the well casing cannot be adjusted.

Some conventional casing gripping tools can be positioned within the targeted section of casing to be removed from the wellbore and then deployed to grip the casing by rotation of the tubular string to which the tool is threadably connected. These tools cannot allow for rotation of a cutting element connected distally to the tool because rotation of the tubular string is used for deploying and retracting the gripping elements of the tool. These conventional casing gripping tools require two trips into the well, the first trip to cut the casing and the second trip to grip and remove the cut section of casing.

Embodiments of the gripping tool and method of the present invention overcome these and other shortcomings of existing methods and tools.

BRIEF SUMMARY

Some embodiments of the gripping tool and method of the present invention provide for the positioning of a gripping tool connected to a tubular string, and a rotary cutting tool connected therebelow, in a well casing having a section targeted for recovery and removal from the well. The gripping tool is adapted to be released from a running configuration, deployed to a gripping mode, and to thereafter enable the rotation of the rotary cutting tool to cut the casing while the gripping tool remains in gripping engagement with the casing at a location above the cutting tool. Torque is transmitted from a tubular string, to which a proximal end of a mandrel of the gripping tool is connected, through the gripping tool to the cutting tool which is connected to a distal end of the mandrel of the gripping tool. The mandrel is rotatable by rotation of the tubular string from the rig while the gripping tool is deployed to grip the casing above the location of the cutting tool. Unlike a marine swivel, an embodiment of the gripping tool of the present invention can be retracted from the gripping mode, restored to a running configuration and repositioned in the casing if the cutting tool or gripping tool become hung up or jammed, or if the first attempt to cut the casing is unsuccessful. Also unlike a marine swivel, embodiments of the gripping tool of the present invention can be used to grip the casing section after the cutting tool is used to cut the casing, and to remove the detached section of casing from the well without the necessity and cost of a second trip into the well with a gripping tool. This results in a substantial savings in rig time due to increased efficiency. Some embodiments of the gripping tool of the present invention can be used in conjunction with a casing pulling tool, or hydraulic casing jack, that uses hydraulic cylinders to provide maximum pulling force to the gripping tool to break the detached section of casing free from cement bonding. If the section of casing to be removed is sufficiently small or if the cement bond is sufficiently weak, an embodiment of the gripping tool of the present invention can be used for pulling and removing the detached section of casing using the draw works on the rig.

One embodiment of the present invention provides a method of removing a section of casing from a cased well, comprising the steps of providing a gripping tool including a mandrel having a proximal connector for connecting to a tubular string, a distal connector for connecting to a rotary cutting device, a flow bore extending from the proximal connector to the distal connector, an exterior surface of the mandrel with a reduced diameter portion intermediate the proximal connector and the distal connector and a larger diameter portion intermediate the reduced diameter portion and the proximal connector, and a threaded portion on the exterior surface of the mandrel, a slide member having a bore and an exterior surface, the bore of the slide member reciprocatably received on a portion of the mandrel intermediate the proximal connector and the distal connector, at least one friction member disposed on the exterior surface of the slide member and radially outwardly biased by at least one friction member spring element, a slip cage portion of the slide member having at least one window through which at least one slip is radially outwardly deployable from a retracted configuration to a deployed configuration to engage and grip an interior wall of a section of casing targeted for removal from a well, and a threaded portion within the bore of the slide member to releasably threadably engage the threaded portion of the exterior surface of the mandrel to releasably secure the mandrel in a running position within the slide member, a reinforceable slotted slip actuator disposed radially inwardly to the slips and having a bore received on the larger diameter portion of the mandrel in the running position, the slotted slip actuator further including a plurality of radially outwardly extending sloped lobes positioned to engage and, upon reinforcement and then axial displacement of the slotted slip actuator, to slidably displace correspondingly sloped lobes disposed on a radially interior portion of the at least one slip, a back-up sleeve received on the reduced diameter portion of the mandrel distal to the larger diameter portion of the mandrel on which the bore of the slip actuator is received, the back-up sleeve aligned with the bore of the slotted slip actuator and movable with the mandrel and relative to the slide member and the slotted slip actuator between a running position, adjacent and axially distal to the bore of the bore of the slotted slip actuator, and a reinforcing position with the back-up sleeve received within the bore of the slotted slip actuator in an enabled position to reinforce the slotted slip actuator against radially inwardly collapse, a collet cage coupled to a distal end of the slide member, the collet cage having a bore and an interior recess and a collet disposed within the collet cage and having a proximal ring, a distal ring and a plurality of angularly spaced collet fingers, each collet finger having a proximal end connected to the proximal ring, a distal end connected to the distal ring, and at least one of the collet fingers including a radially outwardly protruding ridge releasably received into the interior recess in the bore of the collet cage with the collet in a seated position within the collet cage, wherein the collet resists axial displacement from the seated position within the college cage in a proximal direction upon engagement of the distal stop on the mandrel, then connecting a rotary cutting tool to the distal connector of the mandrel, connecting the proximal connector of the mandrel of the gripping tool to a distal end of a tubular string, the tubular string being both extendable into the cased well and rotatable from a rig, extending the tubular string from a rig to position the gripping tool within a section of well casing targeted for removal from the well, rotating the tubular string from the rig to rotate the mandrel to threadably disengage the threaded portion of the exterior surface of the mandrel from the threaded portion of the bore of the slide member to release the gripping tool from the running position, withdrawing the tubular string to displace the mandrel in a proximal direction within the bore of the slide member from the running position, with the back-up sleeve disposed axially adjacent the bore of the slotted slip actuator, to an enabled position with the back-up sleeve axially displaced by the mandrel into the bore of the flexible slip actuator to reinforce the slip actuator, withdrawing the tubular string further to further displace the mandrel in the proximal direction relative to the slide member to displace the collet from the seated position within the collet cage and to thereby displace the back-up sleeve and the reinforced slotted slip actuator received on the back-up sleeve to deploy the at least one slip radially outwardly through the at least one window in the slip cage of the slide member to engage and grip the section of casing, rotating the tubular string to rotate the mandrel within the bore of the back-up sleeve thereon and to operate the cutting tool to cut the casing at a location below the tool as the slide member, the at least one slip, the reinforced slotted slip actuator and the back-up sleeve received within the bore of the slotted slip actuator remain stationary and the tool remains lodged in gripping engagement with the section of casing, cutting the casing to provide a detached section of casing gripped by the gripping tool, and withdrawing the tubular string, the gripping tool, the cutting tool and the detached section of casing from the well, wherein the at least one spring biased friction member on the exterior of the slide member provides frictional resistance to rotation of the slide member of the gripping tool to enable threadably disengaging the threaded portion of the exterior surface of the mandrel from the threaded portion within the bore of the slide member, wherein the at least one spring biased friction member further provides frictional resistance to axial movement of the slide member of the gripping tool to enable insertion of the back-up sleeve on the mandrel into the bore of the slotted slip actuator coupled to the slide member and wherein the gripping tool can be restored from the gripping mode to the running configuration by lowering the tubular string to displace the tubular string and the mandrel connected thereto in a distal direction relative to the slide member to displace the back-up sleeve from the bore of the slotted slip actuator. In one embodiment of the method, the step of providing the gripping tool with the back-up sleeve received on the mandrel and aligned with the bore of the slotted slip actuator comprises providing a gripping tool including a rigid back-up sleeve having a frustoconical exterior taper with a smaller outer diameter end proximal to the bore of the slotted slip actuator and a larger diameter end distal to the bore of the slotted slip actuator, and providing a gripping tool including the slotted slip actuator having a bore comprises providing a gripping tool including a slotted slip actuator having a correspondingly tapered bore for receiving the frustoconical exterior taper of the back-up sleeve, wherein the gripping tool can be restored from the gripping mode to the running configuration by displacing the tubular string and the mandrel in a distal direction relative to the slide member to more easily displace the tapered exterior surface of the back-up sleeve from the correspondingly tapered bore of the slotted slip actuator, and wherein the collet and collet cage prevent premature setting of the at least one slip by requiring a predeterminable amount of displacing force to be applied by the distal stop of the mandrel to the collet to release the collet from the seated position within the collet cage, whereupon the released collet then will bear against the reinforced slotted slip actuator to deploy the at least one slip to grip the casing.

Embodiments of the casing gripping tool of the present invention include a back-up sleeve that is receivable in and removable from the bore of a slotted slip actuator that, once it is reinforced and enabled by insertion of the back-up sleeve into its bore, can be used to deploy the at least one slip to engage and grip the section of casing in which the tool is disposed. The back-up sleeve and the slotted slip actuator together serve the important function of preventing unwanted premature deployment of the casing gripping tool as it is being run into the well. In one embodiment of the casing gripping tool, the slip actuator is shaped like a cone, and the slots extend longitudinally along the conical body of the slip actuator. The slots allow adjacent portions of the slip actuator to be flexibly displaced, in the absence of the back-up sleeve, to close the slots and to allow a degree of flexibility in the adjacent portions so that, even if the slotted slip actuator is inadvertently axially displaced, it remains incapable of engaging and displacing the at least one slip to the deployed and gripping position. The slots of the slip actuator, without the back-up sleeve installed in the bore of the slotted slip actuator, cause the slip actuator to be flexible and compliant, and structurally incapable of displacing the at least one slip to the deployed position to grip the casing. Installation of the back-up sleeve enables and reinforces the slotted slip actuator so that subsequent axial displacement of the reinforced slip actuator will reliably displace the at least one slip to the deployed and gripping position within the casing.

In the running configuration, the back-up sleeve is aligned with the bore of the slotted slip actuator, but distal to the bore of the slotted slip actuator. Once the tool is in position The back-up sleeve is installed into the bore of the slotted slip actuator by removing the tool from the running configuration and then by displacing the mandrel of the tool relative to the slide member of the tool to install the sleeve in the bore of the slotted slip actuator. The tool is removed from the running configuration by rotation of the tubular string, which rotates the mandrel and threadably disengages the mandrel from the slide member. Once threadably disengaged from the slide member, the mandrel can be pulled, by raising the draw works on the rig, to slidably insert the back-up sleeve into the bore of the slotted slip actuator. Once the slip actuator is reinforced and enabled by insertion of the back-up sleeve into its bore, further displacement of the mandrel, by further raising the draw works on the rig, results in the displacement of the mandrel, the back-up sleeve and the slotted slip actuator into which the back-up sleeve is inserted. The displacement of the reinforced slip actuator engages and deploys the at least one slip to engage and grip the casing.

Once an embodiment of the casing gripping tool is deployed to grip the section of casing targeted for removal from the wellbore, the tubular string used to position the casing in the wellbore and to remove the tool from the running configuration (by rotatably threadably disengaging the mandrel from the slide member) can be pulled into tension to tighten the grip of the tool on the section of casing to be removed and to stabilize the tubular string against unwanted movement by sea currents or other forces. A cutting tool that is connected to a distal end of the mandrel can be deployed and the tubular string can then be rotated, while remaining in tension, to operate the deployed cutting tool and to cut the section of casing. Once the casing is cut, the tubular string can be pulled to dislodge the detached section of casing, and the tubular string can be pulled to remove the casing gripping tool, the cutting tool connected thereto, and the detached section of casing gripped thereby from the wellbore. It will be understood that the capacity to cut and remove the targeted section of casing from the wellbore in a single trip of the tubular string saves valuable rig time.

One embodiment of the method of the present invention includes the step of securing at least one spring element intermediate the slide member and each of the at least one slips to bias the at least one slip radially inwardly into the slip cage to the retracted position of the at least one slip, wherein the at least one spring element retains the at least one slip in a retracted position and restores the at least one slip to the retracted position within the slip cage after displacement of the back-up sleeve from the bore of the slotted slip actuator.

One embodiment of the method of the present invention includes the step of providing a gripping tool having a slide member having a bore and an exterior surface with a plurality of angularly spaced friction members disposed on the exterior surface of the slide member and radially outwardly biased by a corresponding plurality of friction member spring elements to increase the frictional resistance to rotational or axial movement of the slide member within the section of casing targeted for removal from the well.

One embodiment of the method of the present invention includes the step of providing a gripping tool having a slide member having a bore and a slip cage portion of the slide member having a plurality of angularly spaced windows through which a corresponding plurality of angularly spaced slips are radially outwardly deployable from a retracted configuration to a deployed configuration to engage and grip the section of casing.

One embodiment of the method of the present invention includes the step of securing at least one spring element intermediate each of the plurality of slips and the slide member to bias each of the plurality of slips radially inwardly into the slip cage to the retracted position, wherein the at least one spring element disposed intermediate each of the plurality of slips and the slide member retains the plurality of slips in the retracted position until the slips are deployed and restores the plurality of slips to the retracted position within the slip cage after displacement of the back-up sleeve from the bore of the slip actuator.

Embodiments of the present invention may also include a gripping tool that can be used to perform the embodiments of the method described herein above. One embodiment of the gripping tool of the present invention comprises a mandrel having a proximal connector for connecting to a tubular string, a distal connector for connecting to a rotary casing cutting device, a flow bore extending through the proximal connector, the mandrel and the distal connector, a radially exterior surface with a reduced diameter portion intermediate a larger diameter portion and the distal connector, and a threaded portion on the exterior surface of the mandrel, a slide member having a bore reciprocatably received on a portion of the mandrel intermediate the proximal connector and the distal connector, at least one friction member disposed along an exterior surface of the slide member, at least one friction member spring element disposed intermediate the slide member and the at least one friction member to bias the at least one friction member radially outwardly from the slide member to provide continuous frictional engagement between the at least one friction member and an interior wall of a casing section into which the gripping tool is inserted, a slip cage portion of the slide member having at least one window through which at least one slip is radially outwardly deployable from a retracted configuration to a gripping configuration to engage and grip, upon deployment of the gripping tool, the interior wall of the section of casing into which the gripping tool is inserted, and a threaded portion within the bore of the slide member to threadably engage the threaded portion on the exterior surface of the mandrel to releasably secure the mandrel in the running position relative to the slide member, a slotted slip actuator having a bore and a plurality of lobes positioned to engage and to slidably displace corresponding lobes on the at least one slip, the slotted slip actuator having a passive mode and a reinforced mode that enables displacement of the one or more slips to the deployed position, a rigid back-up sleeve received on the reduced diameter portion of the mandrel distal to and axially aligned with the bore of the slotted slip actuator which, in the running position, surrounds the larger diameter portion of the mandrel, the back-up sleeve axially movable with the mandrel between a running position, axially adjacent to the bore of the slotted slip actuator, and a reinforcing position with the larger diameter portion of the mandrel removed from the bore of the slotted slip actuator and the back-up sleeve received into the bore of the slotted slip actuator to reinforce the slotted slip actuator against radially inwardly collapse, coupling a collet cage having a bore and a radially inwardly facing recess therein to a distal end of the slide member, disposing a collet having a bore surrounded by a plurality of angularly spaced and longitudinal collet fingers into the bore of the collet cage, each collet finger of the collet coupled at a proximal end to a proximal collet ring, each coupled at a distal end to a distal collet ring, and one or more of the fingers having a radially outwardly projecting ridge disposed on a radially outwardly disposed face of the one or more fingers of the collet, wherein the collet in the collet cage in the running configuration is axially spaced apart from a distal stop on the mandrel a distance corresponding to an axial displacement distance to move the back-up sleeve from the running position axially adjacent to the bore of the slotted slip actuator to the enabled position within the bore of the reinforced slotted slip actuator, and with the one or more radially outwardly projecting ridge of the collet releasably received in a seated position in the radially inwardly disposed recess in the bore of the collet cage and requiring a predeterminable amount of axial displacement force to unseat the collet to move in a proximal direction relative to the collet cage, a rotary cutting tool coupled to the distal connector of the mandrel and spaced apart from the slide member, wherein displacement of the collet in a proximal direction from the seated position within the collet cage enables further movement of the mandrel, the back-up sleeve and the reinforced slotted slip actuator in a proximal direction within the slide member to deploy the one or more slips to the deployed and gripping position within the section of casing targeted for removal, wherein rotation of the tubular string and the mandrel with the gripping tool positioned within the section of casing targeted for removal threadably releases the mandrel from the running position within the slide member, wherein displacement of the released mandrel and the back-up sleeve on the reduced diameter portion of the mandrel in a proximal direction within the bore of the slide member from the running position, with the back-up sleeve disposed axially adjacent the bore of the slotted slip actuator, to an enabled position with the back-up sleeve received into the bore of the slotted slip actuator, reinforces the slotted slip actuator and enables deployment of the one or more slips to grip the casing, wherein pulling a tubular string connected to the proximal connector of the mandrel into tension with the back-up sleeve in the enabled position further displaces the mandrel in the proximal direction relative to the slide member and displaces the back-up sleeve and the reinforced slotted slip actuator together in the proximal direction relative to the slide member to deploy the one or more slips radially outwardly through the one or more windows in the slip cage, wherein the mandrel is rotatable within the back-up sleeve with the tool in the gripping mode to operate the rotary cutting tool to cut the casing as the slide member, the at least one slip, the reinforced slotted slip actuator and the back-up sleeve received therein remain stationary and lodged in gripping engagement with the section of casing, wherein upon completion of a successful cut the tool can be withdrawn from the well along with the detached casing section, wherein the at least one spring biased friction member of the slide member provides frictional resistance to axial movement of the slide member of the gripping tool to enable insertion of the back-up sleeve on the mandrel into the bore of the slotted slip actuator coupled to the slide member, and wherein the gripping tool can be restored from the gripping mode to the running configuration by displacing the mandrel in a distal direction relative to the slide member to displace the back-up sleeve from the bore of the slotted slip actuator. The at least one spring biased friction member provides frictional resistance to rotation of the slide member to enable threadable disengagement of the mandrel from the slide member.

In one embodiment of the gripping tool of the present invention, the rigid back-up sleeve includes a frustoconical exterior taper with a smaller outer diameter end proximal to the bore of the slotted slip actuator and a larger diameter end distal to the bore of the slotted slip actuator, and the slotted slip actuator includes a bore that is correspondingly tapered to receive the frustoconical exterior taper of the back-up sleeve, and wherein the gripping tool can be restored from the gripping mode to the running configuration by displacing the mandrel in a distal direction relative to the slide member to more easily displace the back-up sleeve from the correspondingly tapered bore of the slotted slip actuator.

One embodiment of the gripping tool of the present invention further comprises at least one spring element disposed intermediate the slide member and the at least one slip to bias the at least one slip radially inwardly into the slip cage and towards the slotted slip actuator and the mandrel of the gripping tool, wherein the at least one spring element restores the at least one slip to the retracted position within the slip cage after displacement of the back-up sleeve to the running position axially adjacent to the bore of the slotted slip actuator.

One embodiment of the gripping tool of the present invention comprises a plurality of angularly spaced friction members and a plurality of spring elements disposed intermediate each of the plurality of friction members and the slide member to provide improved frictional resistance to rotational and/or axial movement of the slide member within the casing.

One embodiment of the gripping tool of the present invention comprises a plurality of angularly spaced windows through which a plurality of angularly spaced slips are deployable to engage and grip the interior wall of the section of casing targeted for removal from the wellbore.

One embodiment of the gripping tool of the present invention comprises a flex nut secured to the slide member to provide the threads for engaging the threads on the exterior surface of the mandrel to threadably secure the gripping tool in the running configuration. The mandrel must be rotatably threadably disengaged from the slide member to remove the gripping tool from the running configuration, but the flex nut enables the gripping tool to be restored to the running configuration by moving the mandrel axially relative to the slide member and by engaging the flex nut of the slide member with the threads on the exterior surface of the mandrel. The flex nut includes three or more angularly spaced and cooperating members, each member having a radially inwardly disposed face bearing threads so that the three or more members together provide a threaded receptacle that resists expansion of the three or more members when the mandrel is pulled in a first direction, away from the running configuration, but that expand when the mandrel is pushed in a second and opposite direction, towards the running configuration. The three or more cooperating members of the flex nut are each spring biased radially inwardly to form the threaded receptacle. This arrangement enables non-rotational restoration of the gripping tool from the deployed configuration to the running configuration by simply lowering the draw works on the rig to move the mandrel downwardly to first displace the back-up sleeve from the bore of the slotted slip actuator and then to engage the threads on the exterior surface of the mandrel with the corresponding threads of the receptacle formed by and within the faces of the three or more cooperating members of the flex nut. Upon engagement with the threads of the mandrel, the three or more members of the flex nut are displaced radially outwardly one from the others to allow the threads on the exterior of the mandrel to pass by the threads on the faces of the three or more members of the flex nut until the threads on the mandrel are disposed centrally within the receptacle formed by the flex nut members. The three or more members of the flex nut are spring-biased to converge and to engage one with the others to minimize the diameter of the receptacle and to dispose the threads formed on the faces of the three or more members of the flex nut are restored to threadable engagement with the threads on the exterior surface of the mandrel. It will be understood that the flex nut prevents the necessity of rotating the tubular string in a direction (counterclockwise) that is opposite to the direction of rotation used to threadably disengage the threaded exterior portion of the mandrel from the flex nut (clockwise) because such rotation could loosen or threadably disengage tubular joints or other threaded couplings in the tubular string.

Other embodiments of the method and the gripping tool that can be used to implement an embodiment of the method of the present invention will become apparent from the description of an embodiment of the gripping tool of the present invention that follows. It will be understood that the scope of the present invention is limited only by the claims that follow.

DETAILED DESCRIPTION

Figure 1A:
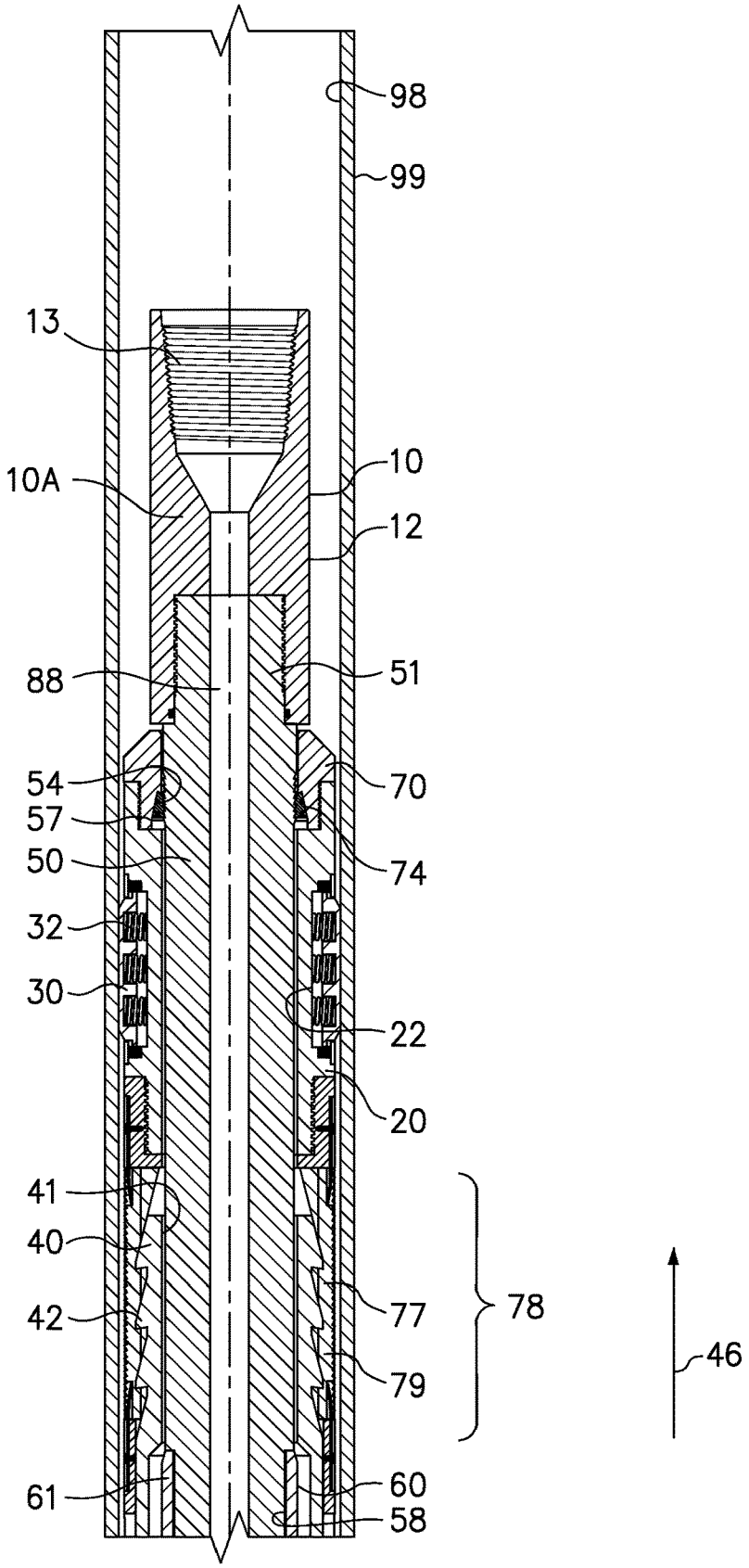
FIG. 1A is an enlarged view of the proximal portion of the embodiment of the gripping tool of the present invention disposed within a cased well in a running configuration.

An embodiment of the casing gripping tool of the present invention provides for rotation of a cutting tool coupled to a distal end of a mandrel of the gripping tool with the gripping tool deployed in a gripping mode to engage and grip an interior wall of a segment of casing targeted for removal from a well. The targeted segment of casing may be a segment of a casing liner that is hung in the wellbore from the top of the casing liner using a liner hanger. An embodiment of the gripping tool of the present invention is adapted to be deployed to grip the section of casing targeted for removal from the wellbore and to simultaneously transmit torque through the mandrel of the gripping tool while the gripping tool remains in the gripping mode to operate a cutting tool coupled to a distal end of the mandrel.

An embodiment of the gripping tool of the present invention provides for rotation of the mandrel and the cutting tool coupled to the mandrel with the tubular string used to run, position and operate the gripping tool and the cutting tool pulled into tension. Operation of the cutting tool with the gripping tool in the gripping mode within the section of casing targeted for removal from the wellbore detaches the targeted section of casing after which the gripping tool, remaining in the gripping mode, the detached section of casing and the cutting tool are together withdrawn from the wellbore.

Embodiments of the gripping tool of the present invention include a mandrel having a proximal connector, a distal connector, a flow bore therethrough, and a slide member reciprocatably received on a portion of the mandrel intermediate the proximal and distal connectors and one or more slips radially outwardly movable through one or more windows in a slip cage portion of the slide member between a retracted position and a gripping position. The gripping tool may be coupled to a tubular string that is stepwise extended into the wellbore from a rig by stepwise addition of joints or stands of the tubular string until the gripping tool reaches a targeted location within a section of casing to be removed from the wellbore. The mandrel of the gripping tool is then rotated to threadably release the gripping tool from a running configuration, and the mandrel is then moved in a proximal direction within the slide member to actuate the gripping tool to grip the interior wall of the section of casing to be removed from the wellbore. The gripping tool enables rotation of the tubular string to rotate the mandrel within the slide member and to detach the section of a targeted interval of casing using a cutting tool that is coupled to the distal connector of the mandrel while the gripping tool remains in gripping engagement with the section of casing to be removed from the wellbore. A bearing is disposed on the slide member to be engaged by the distal stop of the mandrel with the gripping tool in the gripping mode, and the bearing reduces friction between the mandrel and the slide member during rotation of the mandrel and the cutting tool coupled thereto.

Optionally, an embodiment of the gripping tool may be used in conjunction with a rotating casing pulling tool that can be made up into the tubular string above the casing gripping tool and run into a wellbore on a tubular string with a casing cutting tool coupled to the distal connector of the casing gripping tool. It will be understood that a rotating casing pulling tool could be used where the detached section of casing produced by operation of the cutting tool presents such resistance to removal from its position within the wellbore that the casing pulling tool is needed to hydraulically jack the detached section of casing free from the cement jacket that surrounds the casing. The use of a rotating casing pulling tool prevents unwanted overloading and possible damage to components of the tubular string or the rig that might otherwise be sustained during pulling a detached section of casing free from the cement jacket that surrounds it using the tubular string that positions the casing gripping tool in the wellbore.

Figure 1B:
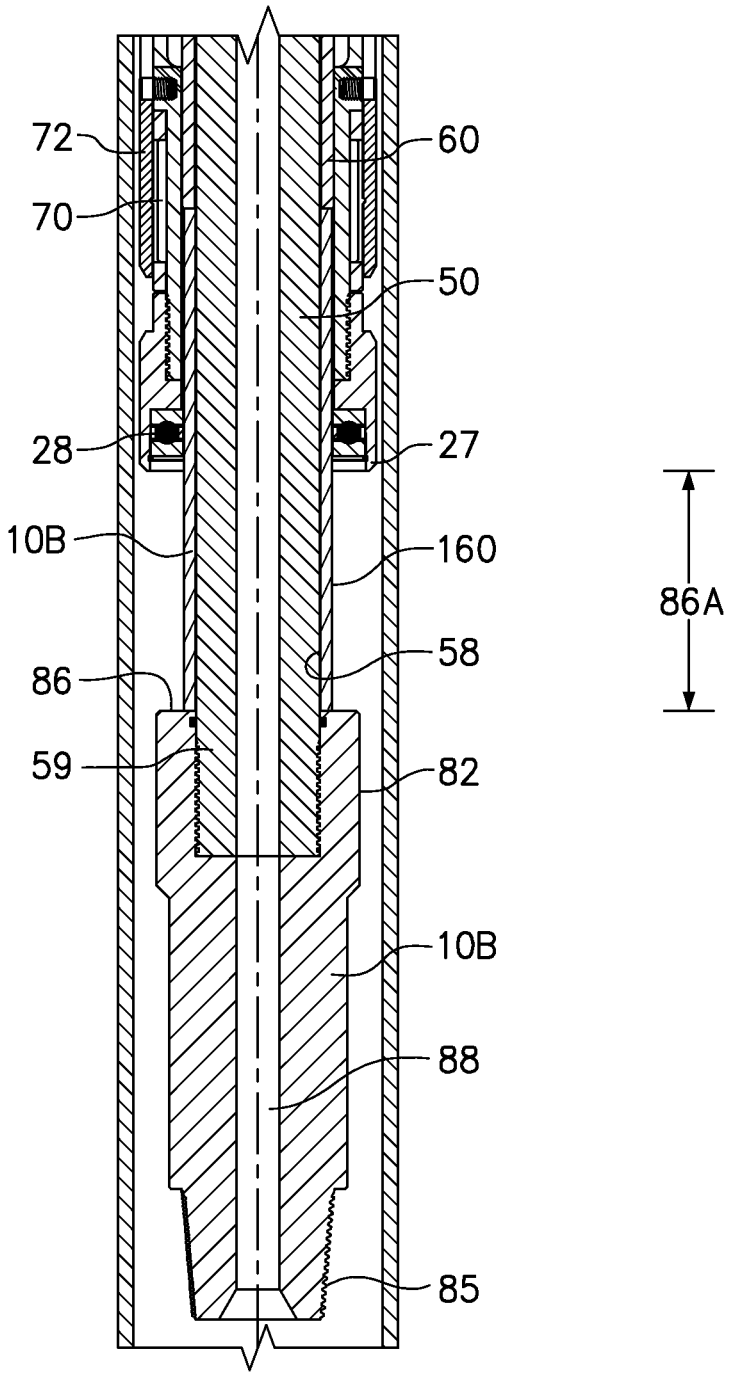
FIG. 1B is an enlarged view of the distal portion of the embodiment of the gripping tool of the present invention disposed within a cased well in a running configuration.

FIGS. 1A and 1B are together an elevation view of an embodiment of the gripping tool of the present invention disposed within a cased well in a running configuration. FIG. 1A is an enlarged view of the proximal portion 10A of the embodiment of the gripping tool 10, and FIG. 1B is an enlarged view of the distal portion 10B of the embodiment of the gripping tool 10.

FIG. 1A illustrates a mandrel 50 including a proximal end 51 connected to a proximal connector 12 having a threaded section 13 for being threadably coupled with a corresponding threaded section at a distal end of an elongate tubular string (not shown) that can be used to position the gripping tool 10 in a well casing 99. FIG. 1A further illustrates the mandrel 50 having an externally threaded portion 54, a reduced diameter sleeve portion 58, and a distal end 59 (shown on FIG. 1B) threadably coupled to a distal connector 82. The distal connector 82 includes a threaded portion 85 for coupling the distal end 59 of the mandrel 50 of the gripping tool 10 to one or more other tools including, but not limited to, a rotary casing cutter (not shown) that can be rotated to cut and detach a section of casing 99 at a targeted position by rotation of the mandrel 50.

Returning to FIG. 1A, the gripping tool 10 of FIG. 1A further includes a slide member 20. The mandrel 50 is rotatably received within the slide member 20 and axially reciprocatable within a restricted range of movement relative to the slide member 20 as will be illustrated further in FIGS. 2A-3B, as discussed in more detail below. The slide member 20 includes one or more friction member recesses 22, a slip cage 78 having a plurality of windows therein and a corresponding plurality of slips 77 coupled to the slide member 20 and movable within the plurality of windows of the slip cage 78 between a radially inwardly retracted configuration illustrated in FIG. 1A and a radially outwardly deployed configuration illustrated in FIG. 3A.

Figure 3A:
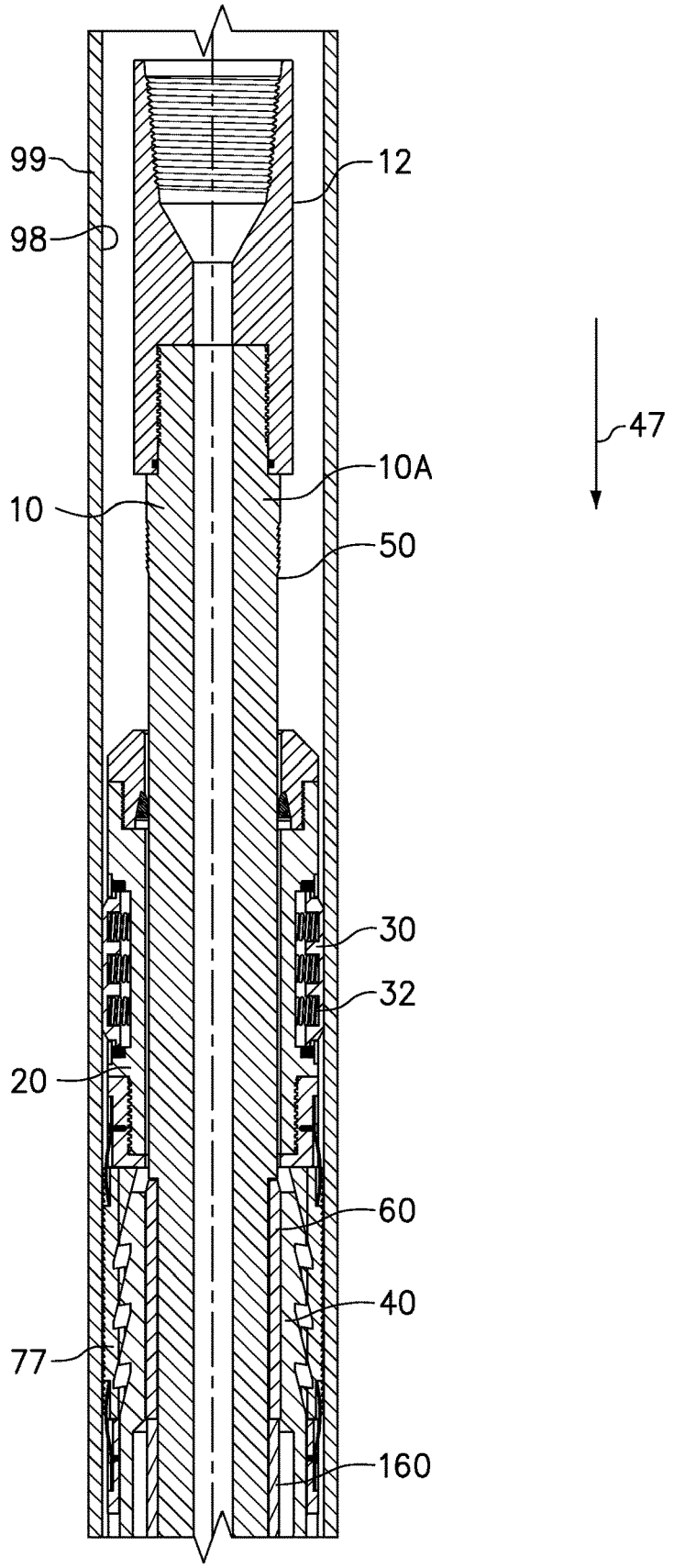
FIG. 3A is an enlarged view of the proximal portion of the embodiment of the gripping tool in the gripping and rotating configuration for use in cutting and removing a section of the well casing.

The gripping tool 10 of FIG. 1A further includes a slotted slip actuator 40 axially movable between a retracted configuration illustrated in FIG. 1A and a deployed configuration illustrated in FIG. 3A. The slotted slip actuator 40 includes a collapsible interior bore 41 having a plurality of radially outwardly sloped lobes 42 extending radially outwardly therefrom to engage and slidably cooperate with correspondingly sloped lobes 79 of the plurality of slips 77. The collapsible interior bore 41 of the slotted slip actuator 40 will partially collapse at the slots and thereby fail to displace the plurality of slips 77 from the retracted position illustrated in FIG. 1A to the deployed configuration illustrated in FIG. 3A unless and until a reinforcing back-up sleeve 60 is disposed within the collapsible interior bore 41 of the slotted slip actuator 40 to provide rigidity and sturdiness to the slip actuator 40. Once the back-up sleeve 60 is moved into position within the flexible interior bore 41 of the slotted slip actuator 40, further axial movement of the now-reinforced slip actuator 40, from the position illustrated in FIGS. 1A and 1*n* the direction of arrow 46 to the position of the slip actuator 40 illustrated in FIG. 3A, results in the slips 77 being radially outwardly displaced by the slip actuator 40 to the deployed and gripping position engaged with the well casing 99.

FIG. 1A also illustrates one or more friction members 30 received within the one or more friction member recesses 22 of the slide member 20. Each friction member 30 is biased towards a radially outwardly disposed position, as illustrated in FIG. 1A, by one or more friction member springs 32 intermediate the friction member 30 and the slide member 20. The friction member 30 and friction member springs 32 provide for continuous frictional engagement between the friction members 30 of the slide member 20 of the gripping tool 10 and the interior wall 98 of the casing 99 in which the gripping tool 10 is disposed. More specifically, the friction member 30 and friction member springs 32 provide for frictional resistance to rotation of the slide member 20 of the gripping tool 10 within the casing 99 and also resistance to axial movement of the slide member 20 of the gripping tool 10 within the casing 99. The benefit and function of the friction member 30 and friction member springs 32 are discussed in more detail below.

Figure 4A:
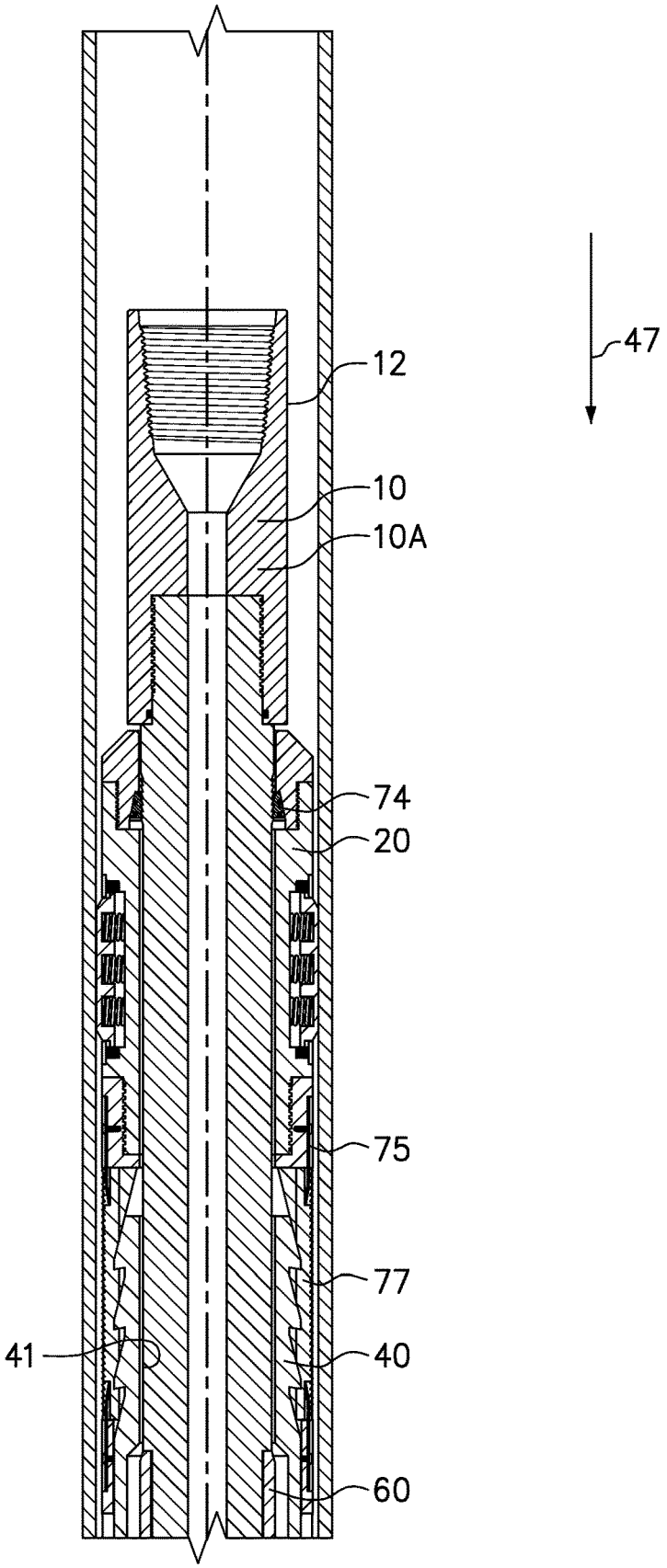
FIG. 4A is an enlarged view of the proximal portion of the embodiment of the gripping tool after it is restored to the running configuration.

The slide member 20 of FIG. 1A further illustrates a flex nut 74 and a flex nut retainer 70 provided for securing the flex nut 74 in position on the slide member 20 of the gripping tool 10. As will be understood by those skilled in the art, a flex nut 74 is a segmented ring with each member of the ring having a radially inwardly disposed face with threads thereon that align with and correspond to the threads on the other segments of the flex ring 74. A typical flex nut 74 generally has three members, and the members of the flex nut 74 are generally about 120 degrees (0.66π radians) each and together form a full ring having a threaded receptacle. The members are held together in a closed configuration using an elastic member such as, for example, a spring element. The flex nut 74 is secured in position about the mandrel 50 and relative to the slide member 20 by the flex nut retainer 70. The flex nut 74 illustrated in FIG. 4 is secured in position within the slide member 20 to dispose the receptable therein to threadably engage the exterior threads 54 on the mandrel 50 to secure the mandrel 50 in the position illustrated in FIG. 4A relative to the slide mandrel 20. The threads within the receptacle of the flex nut 74 remain threadably engaged with the external threads 54 on the mandrel 50 to secure the gripping tool 10 in the running configuration shown in FIGS. 1A and 1B. The mandrel 50 may be rotated in a clockwise direction a sufficient number of rotations to threadably disengage the exterior threaded portion 54 of the mandrel 50 from the threads within the receptacle of the flex nut 74, thereby allowing the mandrel 50 to be moved axially and in the direction of arrow 46 within the slide member 20.

Figure 3B:
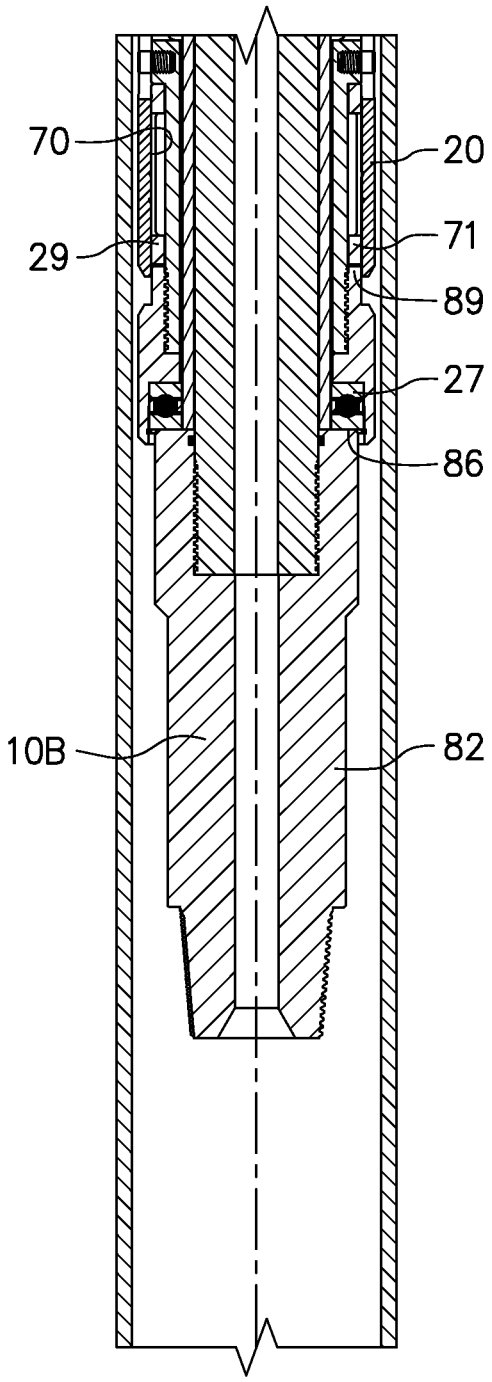
FIG. 3B is an enlarged view of the distal portion of the embodiment of the gripping tool in the gripping and rotating configuration for use in cutting and removing a section of the well casing.

The flex nut 74 can function as a ratcheting component during restoration of the mandrel 50 from the disengaged configuration illustrated in FIGS. 3A and 3B to the running configuration of FIGS. 1A and 1B and also in 4A and 4B. More specifically, the flex nut 74 can be circumferentially and elastically expanded to allow the mandrel 50 to be restored from the rotating and gripping configuration of FIGS. 3A and 3B to the running configuration of FIGS. 1A and 1B and also 4A and 4B by moving the tubular string, to which the proximal connector 12 on the mandrel 50 is coupled, along with the mandrel 50, in the distal direction relative to the slide member 20. A spring element expandably secures threaded members of the flex ring 74 one to the others and restores the flex nut 74 to its original configuration to again engage the threaded portion 54 of the mandrel 50 and to resist movement of the mandrel 50 within the slide member 20. It should be noted that the flex nut compartment 57 of the slide member 20 in which the flex nut 74 resides is inwardly tapered in the proximal direction to dispose the members of the flex nut 74 radially inwardly when the mandrel 50 is pulled in a proximal direction relative to the slide member 20, the shape of the flex nut compartment 57 secures the flex nut 74 in the unexpanded configuration to maintain threadable engagement between the externally threaded portion 54 of the mandrel 50 and receptacle of the flex nut 74. However, once the mandrel 50 has been rotated in a clockwise direction to theadably disengage the externally threaded portion 54 of the mandrel 50 from the flex nut 74 secured within the flex nut compartment 57 of the slide member 20 and the mandrel 50 has been moved in a proximal direction relative to the slide member 20 to the position shown in FIG. 3A, the mandrel 50 can be restored to the running configuration without rotation by moving the mandrel 50 in the distal direction relative to the slide member 20. The receptacle of the flex nut 74 will elastically expand as the members of the flex nut 74 are pushed downwardly into the flex nut compartment 57 by the externally threaded portion 54 of the mandrel 50, and the threaded portion 54 of the mandrel 50 can then be disposed within the receptacle of the flex nut 74 and the flex nut 74 will elastically converge and threadably engage the threaded portion 54 of the mandrel 50 to restore the gripping tool 10 to the running configuration shown in FIGS. 1A and 1B and also in FIGS. 4A and 4B.

FIG. 1B illustrates a distal connector 82 coupled to the distal end 59 of the mandrel 50 of the gripping tool 10, the distal connector 82 having a threaded portion 85 for use in connecting one or more rotary cutting tools (not shown in FIG. 1B) to the mandrel 50 for rotation with the mandrel 50. For example, but not by way of limitation, a casing cutting tool (not shown) can be secured to the mandrel 50 at the threaded portion 85 of the distal connector 82 and, with the gripping tool 10 removed from the running configuration, rotated to cut the casing 99 while the gripping tool 10 grips the casing 99 in the configuration illustrated in FIGS. 3A and 3B in which the plurality of slips 77 are deployed.

FIG. 1B further illustrates a distal stop 86 on the distal connector 82. The distal stop 86 is, in the running configuration of the gripping tool 10 illustrated in FIGS. 1A and 1B, spaced apart from a bearing housing 27 of the gripping tool 10 at a distance of 86A. The spacing 86A is discussed in further detail in connection with FIGS. 2A and 2B below. FIG. 1A further illustrates a collet 70 and collet cage 72 that can be included in the gripping tool 10 to provide for a minimal threshold amount of force that must be applied by the distal stop 86 against the bearing housing 27 to move the reinforced slip actuator 40 and to radially outwardly deploy the plurality of slips 77 into gripping engagement with the bore 98 of the casing 99 as illustrated in the configuration of the gripping tool 10 in FIGS. 3A and 3B.

FIGS. 1A and 1B further illustrate a proximal end 61 of a back-up sleeve 60 (back-up sleeve 60 is shown on both of FIGS. 1A and 1B) received on a reduced diameter portion 58 of the mandrel 50 adjacent to a pusher sleeve 160 (shown on FIG. 1B). The pusher sleeve 160 extends between the distal stop 86 of the distal connector 82 to the back-up sleeve 60. Movement of the mandrel 50 relative to the slide member 20 from the position illustrated in FIGS. 1A and 1B to the position illustrated in FIGS. 2A and 2B disposes the back-up sleeve 60 into the bore 41 of the slotted slip actuator 40 to reinforce the slip actuator 40 and to thereby enable deployment of the plurality of slips 77. Deployment of the slips 77 is achieved by further movement of the mandrel 50 and the reinforced slip actuator 40 from the position illustrated in FIGS. 2A and 2B in a proximal direction relative to the slide member 40 to the position illustrated in FIGS. 3A and 3B to displace the plurality of slips 77 to the deployed position.

Figure 2A:
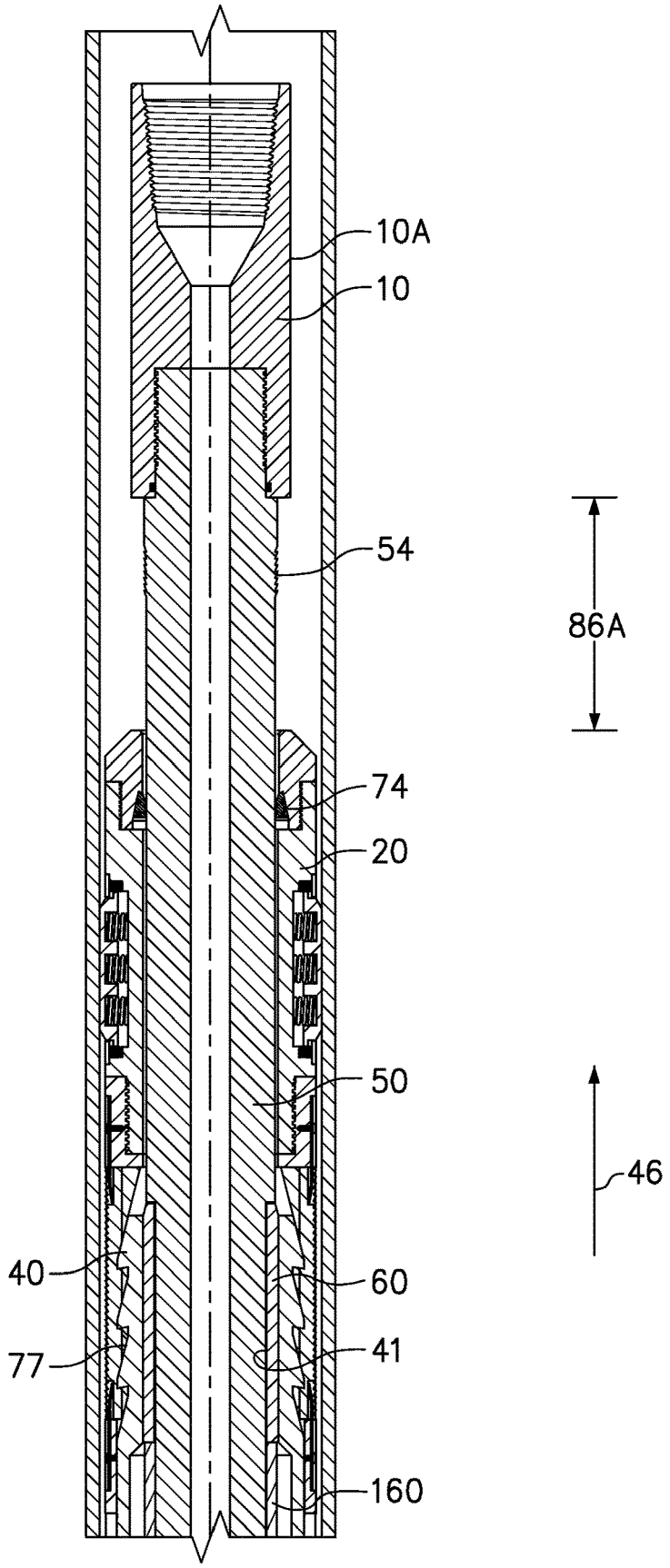
FIG. 2A is an enlarged view of the proximal portion of the embodiment of the gripping tool after the gripping tool is removed from the running configuration.
Figure 2B:
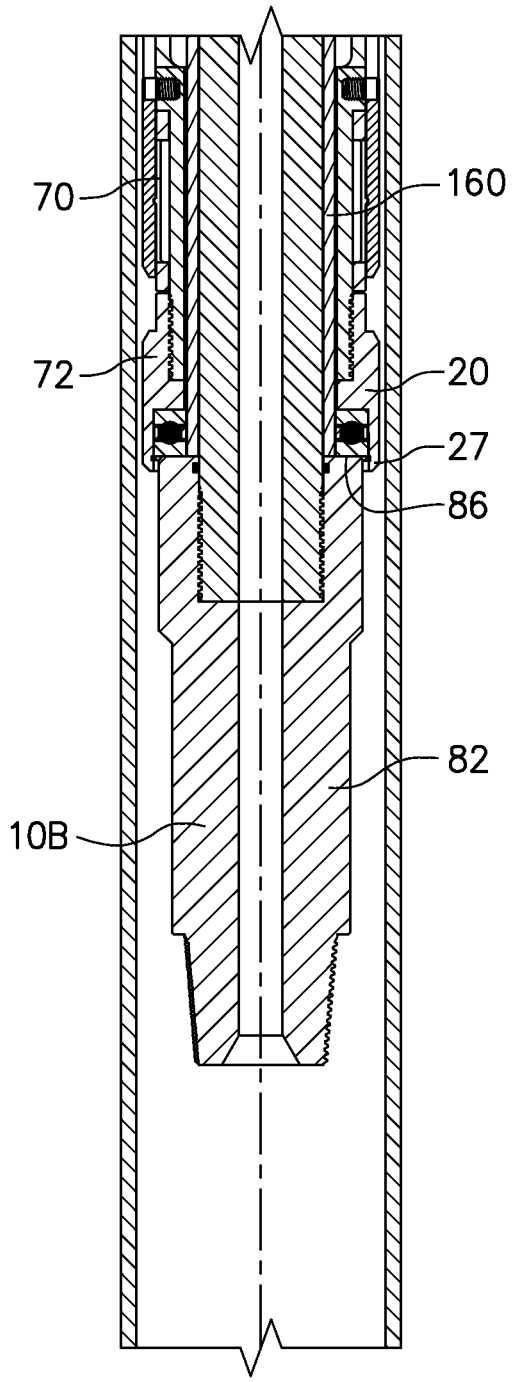
FIG. 2B is an enlarged view of the distal portion of the embodiment of the gripping tool after the gripping tool is removed from the running configuration.

FIGS. 2A and 2B are together an elevation view of the embodiment of the gripping tool of FIGS. 1A and 1B after the mandrel 50 of the gripping tool 10 is rotated in a clockwise direction to threadably disengage the externally threaded portion 54 of the mandrel 50 from the flex nut 74 within the slide member 20 and the gripping tool 10 is thereby removed from the running configuration illustrated in FIGS. 1A and 1B.

FIG. 2A is an enlarged view of the proximal portion 10A of the embodiment of the gripping tool 10 and illustrates the externally threaded portion 54 of the mandrel 50 displaced from the slide member 20 by the same distance 86A that corresponds to the distance 86A that initially separated the distal stop 86 on the distal connector 82 from the bearing housing 27 in FIGS. 1A and 1B of the gripping tool 10. As can be seen in FIG. 2B, the enlarged view of the distal portion 10B of the embodiment of the gripping tool 10, the distal stop 86 on the distal connector 82 is now engaged with the bearing housing 27. The mandrel 50 is moved to the position illustrated in FIG. 2A by first rotating the tubular string (not shown) and the mandrel 50 to which the tubular string is connected at the proximal connector 12 in a clockwise direction to threadably disengage the externally threaded portion 54 of the mandrel 50 from the flex nut 74 secured to the slide member 20, and then by raising the tubular string (not shown) along with the proximal connector 12 and the mandrel 50 to move the distal stop 86 of the distal connector 82 (shown on FIG. 2B) into engagement with the bearing housing 27 and, by the same movement of the mandrel 50, to push the distal stop 86 against the pusher sleeve 160 to push the back-up sleeve 60 into the collapsible interior bore 41 of the slotted slip actuator 40. Once the back-up sleeve 60 is displaced into the collapsible interior bore 41 of the slotted slip actuator 40, further movement of the mandrel 50 from the position illustrated in FIGS. 2A and 2B and in the direction of arrow 46 will displace the back-up sleeve 60, the collapsible interior bore 41 of the slotted slip actuator 40 and the slip actuator 40 in a proximal direction to overcome the retaining force of the collet 70 within the collet cage 72 and to thereby deploy the plurality of slips 77 from the retracted position illustrated in FIG. 2A to the deployed position illustrated in FIG. 3A.

FIG. 2B is an enlarged view of the distal portion 10B of the embodiment of the gripping tool 10. Comparing the enabled position of the gripping tool 10 shown in FIG. 2B to the running position illustrated in FIG. 1B, it can be seen that the distal stop 86 on the distal connector 82 has moved in a proximal direction to engage the bearing housing 27 of the slide member 20. The collet 70 and collet cage 72 of the slide member 20 remain in the running position illustrated in FIG. 1B until acted upon by the distal stop 86 of the distal connector 82.

FIGS. 3A and 3B are together an elevation view of the embodiment of the gripping tool 10 of FIGS. 2A and 2B after it has been moved to the gripping and rotating configuration for use in cutting and removing a detached section of the well casing 99.

FIG. 3A is an enlarged view of the proximal portion 10A of the embodiment of the gripping tool 10. FIG. 3A illustrates that the mandrel 50 has been moved further in the proximal direction relative to the slide member 20 from the enabled position of FIGS. 2A and 2B to the gripping position of FIGS. 3A and 3B. The proximal connector 12 is illustrated in FIG. 3A as being displaced further in the proximal direction from the slide member 20 from the enabled position, illustrated in FIG. 2A, and the reinforced slip actuator 40 with the back-up sleeve 60 received therein is illustrated as having been displaced axially in the proximal direction to radially outwardly deploy the plurality of slips 77 to engage and grip the interior wall 98 of the casing 99. In the position of the proximal portion 10A of the gripping tool 10 illustrated in FIG. 3A, pulling tension in the tubular string (not shown) to pull the mandrel 50 in the proximal direction sets the slips 77 further into forcible engagement with the casing 99 while continuing to enable rotation of the mandrel 50 within the slide member 20 to rotate a cutting tool (not shown) connected to the distal connector 82 of the mandrel 50 (see FIG. 3B) to cut and detach the section of casing 99 targeted for removal from the wellbore.

FIG. 3B is an enlarged view of the distal portion 10B of the embodiment of the gripping tool 10 of FIG. 3 and illustrates that the collet 70 has been unseated from the seated position within the collet cage 72, which is illustrated in FIGS. 1A and 2A, to the unseated position illustrated in FIG. 3B. Unseating of the collet 70 from the collet cage 72 engages and axially displaces the reinforced slip actuator 40 to radially outwardly deploy the plurality of slips 77 to engage and grip the casing 99. As shown in FIGS. 2B and 3B, the amount of axial displacement of the mandrel 50 from the enabled position of FIG. 2B to the gripping and rotating position of FIG. 3B is small compared to the much larger axial displacement of the mandrel 50 (by the distance 46A shown in FIG. 1B) required to insert the back-up sleeve 60 into the bore 41 of the slip actuator 40. The configuration of the gripping tool 10 illustrated in FIGS. 3A and 3B allow the tubular string (not shown) connecting the rig to the proximal connector 12 on the mandrel 50 to be pulled into tension and rotated to operate the rotary cutter (not shown) connected to the distal connector 82 of the mandrel 50.

After the section of casing 99 targeted for removal from the borehole is detached by operation of the cutting tool (not shown) connected to the distal connector 82 of the mandrel 50, the pulling tension maintained on the tubular string (not shown) connected to the mandrel 50 may, as a result of pulling the tubular string into tension, dislodge the detached section of casing 99 from its position within the wellbore. If the detached section of casing 99 is not dislodged, increasing the pulling tension in the tubular string further deploys the slips 77 into gripping engagement with the casing 99 in a self-tightening grip until the detached section of casing 99 is dislodged and can be pulled from the well.

It will be understood that during downhole operations, tools may become jammed or hung-up due to well obstructions or other unforeseen problems. It is advantageous if a casing gripping tool can be released and reset for a second attempt at setting the tool and cutting the section of casing. Embodiments of the gripping tool 10 of the present invention can be reset from the gripping position illustrated in FIGS. 3A and 3B to the running position of FIGS. 1A and 1B (and also of FIGS. 4A and 4B) in the event of difficulty by moving the draw works on the rig (not shown), the tubular string connected thereto and the mandrel 50 downwardly and in the direction of arrow 47 in FIG. 3A to displace the back-up sleeve 60 from the bore 41 of the slotted slip actuator 40 and to restore the proximal connector 12 on the mandrel 50 to a position abutting the slide member 20 as illustrated in FIG. 4A. Displacing the back-up sleeve 60 from the bore 41 of the slip actuator 40 allows the slip springs 75 to restore the slips 77 to the retracted position. It will be understood from the discussion of the flex nut 74 above that simply moving the mandrel 50 in the direction of arrow 47 relative to the slide member 20 will restore the gripping tool 10 to the running configuration. Once the tool is restored to the running configuration, the gripping tool 10 can be repositioned within the wellbore and redeployed.

Figure 4B:
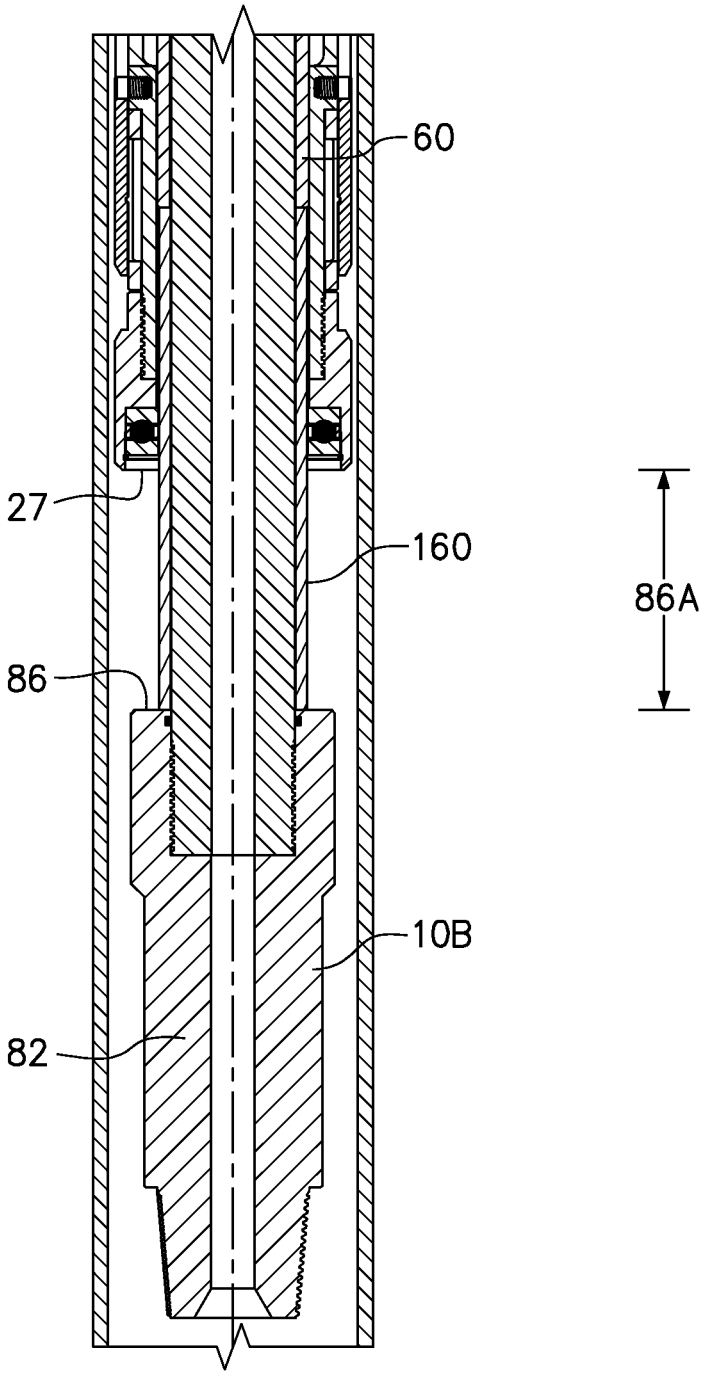
FIG. 4B is an enlarged view of the distal portion of the embodiment of the gripping tool after it is restored to the running configuration.

FIGS. 4A and 4B are together an elevation view of the embodiment of the gripping tool 10 of FIGS. 1A and 1B through 3A and 3B after it is restored to the running configuration by downward movement of the tubular string (not shown) to reposition the mandrel 50 to the running position within the slide member 20.

FIG. 4A is an enlarged view of the proximal portion 10A of the embodiment of the gripping tool 10. The slips 77 are restored to the retracted position by a slip spring 75 disposed intermediate the slide member 20 and each slip 77. The mandrel 50 and the back-up sleeve 60 thereon are restored to the running configuration and the flexible slip actuator 40, no longer reinforced by the back-up sleeve 60 received in its bore (as shown in FIGS. 2A and 2B and also in FIGS. 3A and 3B), is restored to the running configuration with its bore aligned with the back-up sleeve 60 received on the mandrel 50. The restored running position illustrated in FIG. 4A corresponds to the original running position illustrated in FIG. 1A.

FIG. 4B is an enlarged view of the distal portion 10B of the embodiment of the gripping tool 10 of FIG. 4 illustrating the restored running configuration of the gripping tool 10 of the present invention. The distal stop 86 is again separated from the bearing housing 27 of the slide member 50 by the distance 86A and the collet 70 has been moved by force applied by the slip actuator 40 in the distal direction relative to the slide member 20 to the seated position within the collet cage 72. The restored running position illustrated in FIG. 4B corresponds to the original running position illustrated in FIG. 1B.

Figure 5A:
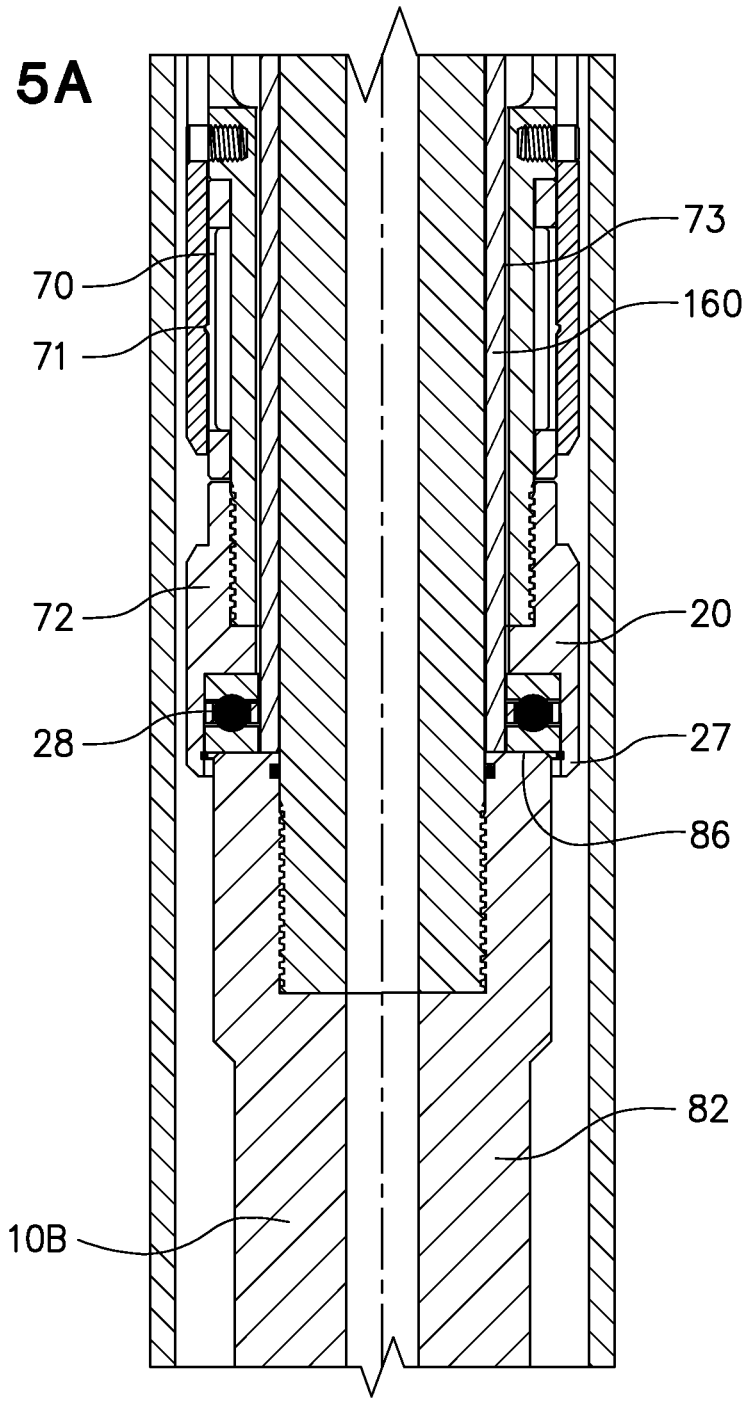
FIG. 5A is an enlarged view of the portion of FIG. 2B illustrating the seated mode of the collet and collet cage.
Figure 5B:
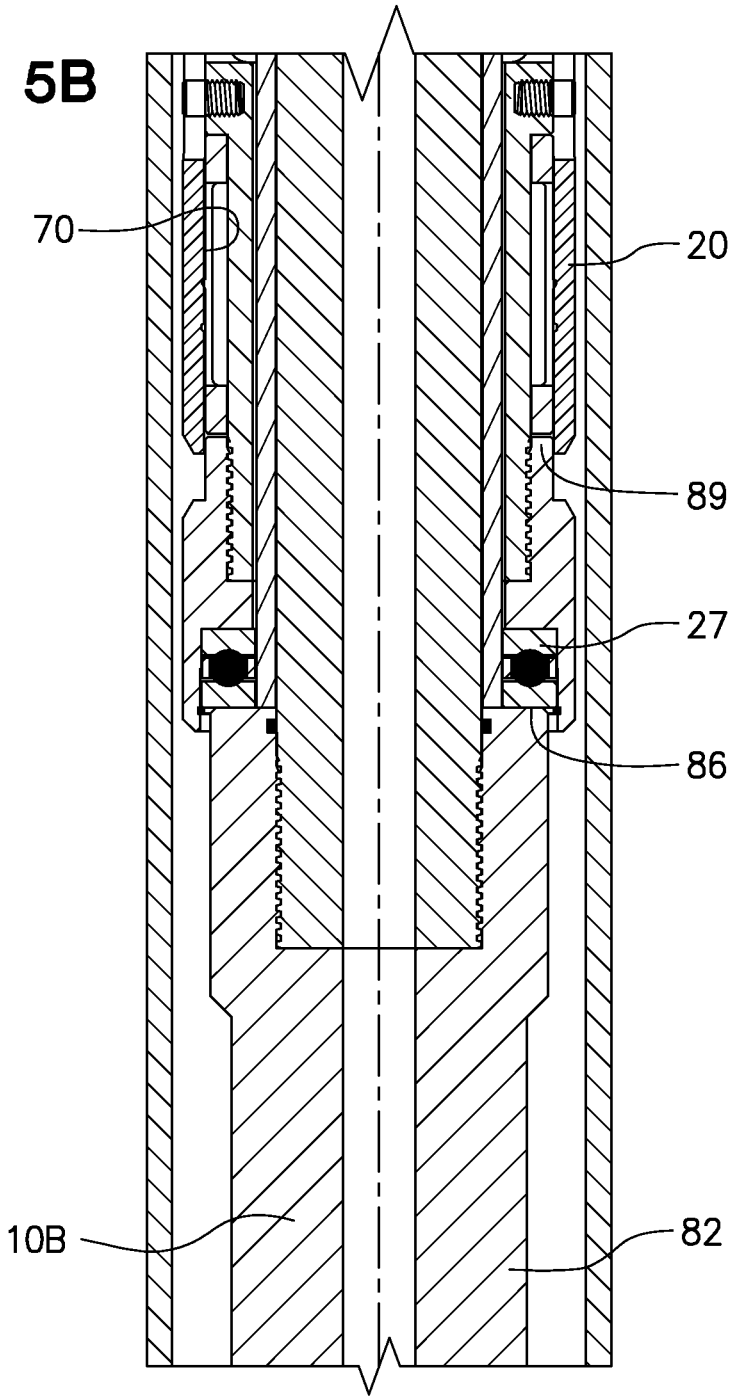
FIG. 5B is an enlarged view of the portion of FIG. 3B illustrating the unseated mode of the collet that allows the force applied from the mandrel to be applied to the slip actuator.

FIG. 5A is an enlarged view of a portion of FIG. 3B better illustrating the collet 70 in the seated position within the collet cage 72. The collet 70 and the collet cage 72 together operate as a mechanical fuse element by preventing displacement of the slotted slip actuator 40 until it is reinforced by insertion of the back-up sleeve 60 into the bore 41 of the slip actuator 40. Once the initial portion of the stroke of the mandrel 50 within the slide member 20 installs the back-up sleeve 60 into the bore 41 of the slip actuator 40 and moves the distal stop 86 on the distal connector 82 into engagement with the bearing housing 27, further movement of the mandrel 50 in a proximal direction within the slide member 20 brings the distal stop 82 to apply pressure on the bearing housing 27 which, in turn, transfers the force applied to the bearing housing 27 to the collet 70. The collet 70 is retained in place within the collet cage 72 by a radially outwardly disposed protrusion 71 disposed in a corresponding radially inwardly disposed notch 73 in the collet cage 72. At the moment that the pressure applied by the distal stop 82 to the bearing housing 27 and the collet 70 exceeds the retaining capacity of the collet 70, the protrusion 71 of the collet 70 will unseat from the notch 73 in the collet cage 72 as illustrated in FIG. 5B and the unseated collet 70 will transfer force from the distal stop 86 through the bearing housing 27 and the unseated collet 70 to the reinforced slip actuator 40 (see FIGS. 3A and 4A) to axially displace the reinforced slip actuator 40 and to radially outwardly displace the slips 77 to grip the casing 99.

Figure 6:
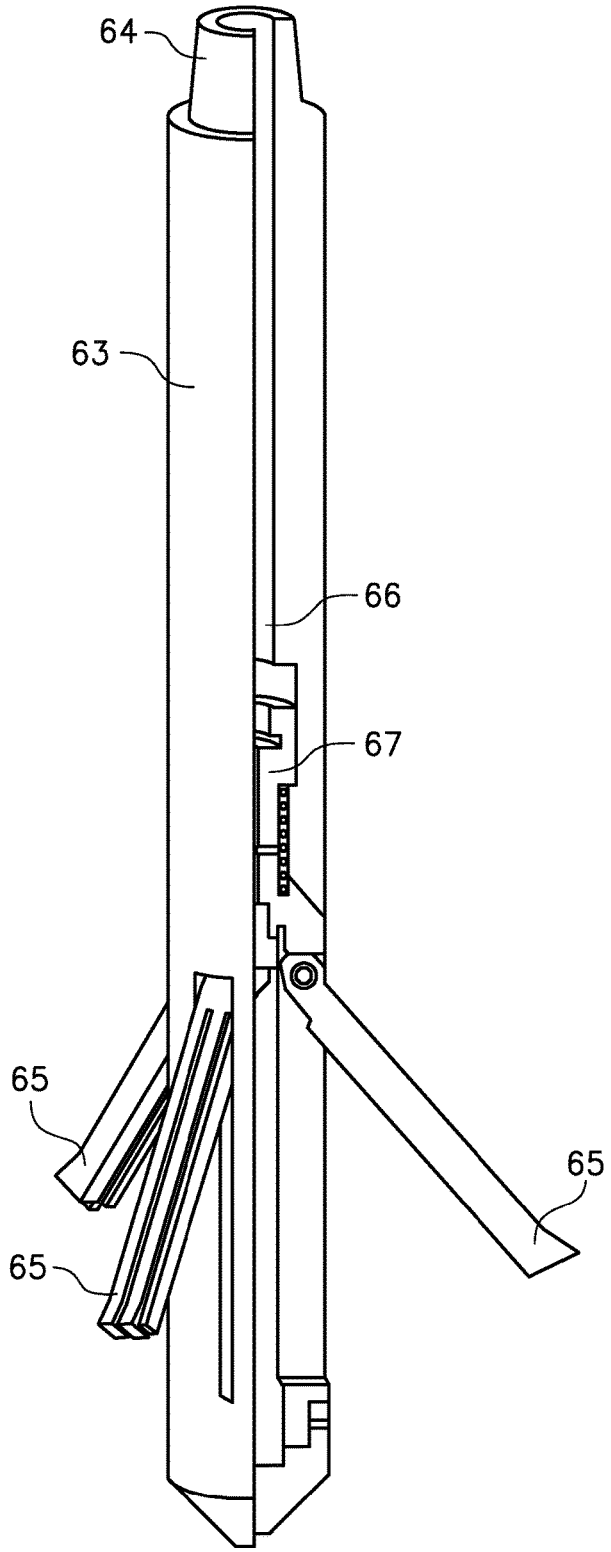
FIG. 6 is a rotary cutting tool of the type that can be used in conjunction with embodiments of the casing gripping tool of the present invention.

FIG. 6 is a rotary cutting tool 63 of the type that can be used in conjunction with embodiments of the casing gripping tool 10 of the present invention. The rotary cutting tool 63 includes a threaded proximal end 64 for threadably engaging the threaded portion 85 on the distal connector 82 of the casing gripping tool 10 shown in FIG. 1B. The rotary cutting tool 63 further comprises a plurality of pivotally deployable cutting elements 65, each of which is deployable by a fluid pressure actuator 67 that is operated by fluid pressure in the bore 66 of the rotary cutting tool 63.

Figure 7:
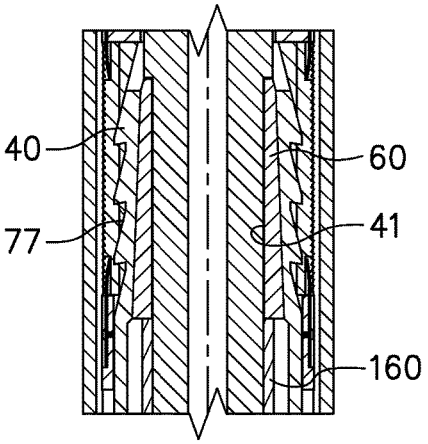
FIG. 7 is an enlarged view of an alternate slotted slip actuator and the back-up sleeve that can be included in an embodiment of the casing gripping tool of the present invention.

FIG. 7 is an enlarged view of an alternate slotted slip actuator 40 and the back-up sleeve 60 that can be included in an embodiment of the casing gripping tool 10 of the present invention. The alternate slotted slip actuator 40 of FIG. 7 has a frusto-conical bore having a taper along its axial length, and the back-up sleeve 60 has a correspondingly frusto-conical or tapered exterior for being received and engaged with the frusto-conical interior bore 41 of the slotted slip actuator 40. The advantage of the frusto-conical bore of the alternate slotted slip actuator 40 and the correspondingly frusto-conical exterior of the back-up sleeve 60 is that the back-up sleeve 60, which is pushed into the position shown in FIG. 7 by the pusher sleeve 160 prior to deployment of the slips 77, can later be more easily displaced downwardly from the tapered interior bore 41 of the slotted slip actuator 40 upon retraction of the slips 77 and restoration of the casing gripping tool 10 from the gripping and rotating configuration illustrated in FIGS. 3A and 3B to the running configuration illustrated in FIGS. 4A and 4B.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method of removing a section of casing from a cased well, comprising:

providing a gripping tool including:

a mandrel having a proximal connector for connecting to a tubular string, a distal connector for connecting to a rotary cutting tool, a flow bore extending from the proximal connector to the distal connector, an exterior surface with a reduced diameter portion intermediate the proximal connector and the distal connector and a larger diameter portion intermediate the reduced diameter portion and the proximal connector, and a threaded portion on the exterior surface of the mandrel;

a slide member having a bore and an exterior surface, the slide member reciprocatably received on a portion of the mandrel intermediate the proximal connector and the distal connector, at least one friction member disposed on the exterior surface of the slide member and radially outwardly biased by at least one friction member spring element, a slip cage portion of the slide member having at least one window through which at least one slip is radially outwardly deployable from a retracted configuration to a deployed configuration to engage and grip an interior wall of the section of casing targeted for removal from the well, and a threaded portion within the bore of the slide member to threadably engage the threaded portion on the exterior surface of the mandrel to releasably secure the mandrel in a running position within the slide member;

a flexible slip actuator having a bore received on the larger diameter portion of the mandrel in the running position, the slip actuator further including a plurality of radially outwardly extending sloped lobes positioned to engage and, upon reinforcement and then axial displacement of the slip actuator, to slidably displace correspondingly sloped lobes disposed on a radially interior portion of the at least one slip;

a rigid back-up sleeve received on the reduced diameter portion of the mandrel adjacent to the larger diameter portion of the mandrel on which the bore of the slip actuator is received in the running position, the back-up sleeve aligned with the bore of the slip actuator and movable with the mandrel and relative to the slide member between a running position, adjacent and axially distal to the bore of the slip actuator, and a reinforcing position with the back-up sleeve received within the bore of the slip actuator to reinforce the slip actuator against radially inwardly collapse;

a collet cage coupled to a distal end of the slide member, the collet cage having a bore and an interior recess; and a collet having a proximal ring, a distal ring and a plurality of angularly spaced collet fingers, each of the collet fingers having a proximal end connected to the proximal ring, a distal end connected to the distal ring, and at least one of the collet fingers including a radially outwardly protruding ridge releasably received into the interior recess in the bore of the collet cage with the collet in a seated position within the collet cage, wherein the collet resists axial displacement by a distal stop on the mandrel in a proximal direction from the seated position;

connecting the rotary cutting tool to the distal connector of the mandrel;

connecting the proximal connector of the mandrel of the gripping tool to a distal end of the tubular string, the tubular string being both extendable into the cased well and rotatable from the rig;

extending the tubular string from the rig to position the gripping tool within the section of well casing targeted for removal from the well;

rotating the tubular string from the rig to rotate the mandrel to threadably disengage the threaded portion of the exterior surface of the mandrel from the threaded portion of the bore of the slide member to release the gripping tool from the running position;

withdrawing the tubular string to displace the mandrel in the proximal direction within the bore of the slide member from the running position, with the back-up sleeve disposed axially adjacent the bore of the flexible slip actuator, to an enabled position with the back-up sleeve axially displaced by the mandrel into the bore of the flexible slip actuator to reinforce the slip actuator;

withdrawing the tubular string further to further displace the mandrel in the proximal direction relative to the slide member to displace the back-up sleeve and the reinforced slip actuator received on the back-up sleeve to deploy the at least one slip radially outwardly through the at least one window in the slip cage of the slide member to engage and grip the section of casing;

rotating the tubular string to rotate the mandrel within the bore of the back-up sleeve thereon and to operate the cutting tool to cut the casing as the slide member, the at least one slip, the reinforced slip actuator and the back-up sleeve received in the bore of the slip actuator remain stationary and lodged in gripping engagement with the section of casing;

cutting the casing to provide a detached section of casing gripped by the gripping tool; and withdrawing the tubular string, the gripping tool, the cutting tool and the detached section of casing from the well;

wherein the at least one spring biased friction member provides frictional resistance to rotation of the slide member of the gripping tool to enable threadably disengaging the threaded portion of the exterior surface of the mandrel from the threaded portion within the bore of the slide member;

wherein the at least one spring biased friction member further provides frictional resistance to axial movement of the slide member of the gripping tool to enable insertion of the back-up sleeve on the mandrel into the bore of the flexible slip actuator coupled to the slide member; and wherein the gripping tool can be restored from a gripping mode to a running configuration by displacing the tubular string and the mandrel in a distal direction relative to the slide member to displace the back-up sleeve from the bore of the slip actuator.

2. The method of claim 1, wherein the rigid back-up sleeve includes a frustoconical exterior taper with a smaller outer diameter leading end proximal to the bore of the slip actuator and a larger diameter trailing end distal to the bore of the slip actuator;

wherein the flexible slip actuator includes a bore that is correspondingly tapered to receive the frustoconical exterior taper of the back-up sleeve;

wherein the gripping tool can be restored from the gripping mode to the running configuration by displacing the tubular string and the mandrel in a distal direction relative to the slide member to more easily displace the tapered exterior surface of the back-up sleeve from the correspondingly tapered bore of the slip actuator; and wherein the collet and collet cage prevent premature setting of the at least one slip by requiring a predeterminable amount of displacing force to be applied by the distal stop of the mandrel to the collet to release the collet from the seated position, whereupon the released collet then will bear against the reinforced slip actuator to deploy the at least one slip.

3. The method of claim 1, further comprising:

securing at least one spring element intermediate the slide member and the at least one slip to bias the at least one slip radially inwardly into the slip cage to the retracted configuration of the at least one slip;

wherein the at least one spring element retains the at least one slip in the retracted configuration and restores the at least one slip to the retracted configuration within the slip cage after displacement of the back-up sleeve from the bore of the slip actuator.

4. The method of claim 1, wherein the slide member with at least one friction member disposed along an exterior surface of the slide member and at least one friction member spring element disposed intermediate the slide member and the at least one friction member comprises a plurality of angularly spaced friction members and a plurality of friction member spring elements disposed intermediate each of the plurality of friction members and the slide member.

5. The method of claim 1, wherein the slip cage portion of the slide member comprises a plurality of angularly spaced windows through which a corresponding plurality of angularly spaced slips are radially outwardly deployable from a retracted configuration to a deployed configuration to engage and grip the section of casing.

6. The method of claim 5, further comprising:

securing at least one spring element intermediate each of the plurality of slips and the slide member to bias each of the plurality of slips radially inwardly into the slip cage to the retracted configuration;

wherein the at least one spring element disposed intermediate each of the plurality of slips and the slide member retains the plurality of slips in the retracted configuration until the slips are deployed and restores the plurality of slips to the retracted configuration within the slip cage after displacement of the back-up sleeve from the bore of the slip actuator.

7. A gripping tool, comprising:

a mandrel having a proximal connector for connecting to a tubular string, a distal connector for connecting to a rotary casing cutting tool, a flow bore extending through the proximal connector, the mandrel and the distal connector, a radially exterior surface with a reduced diameter portion intermediate a larger diameter portion and the distal connector, and a threaded portion on the exterior surface of the mandrel;

a slide member having a bore reciprocatably received on a portion of the mandrel intermediate the proximal connector and the distal connector, at least one friction member disposed along an exterior surface of the slide member, at least one friction member spring element disposed intermediate the slide member and the at least one friction member to bias the at least one friction member radially outwardly from the slide member to provide continuous frictional engagement between the at least one friction member and an interior wall of a casing section into which the gripping tool is inserted, a slip cage portion of the slide member having at least one window through which at least one slip is radially outwardly deployable from a retracted configuration to a gripping configuration to engage and grip, upon deployment of the gripping tool, the interior wall of the section of casing into which the gripping tool is inserted, and a threaded portion within the bore of the slide member to threadably engage the threaded portion on the exterior surface of the mandrel to releasably secure the mandrel in the running position relative to the slide member;

a flexible slip actuator having a bore and a plurality of lobes positioned to engage and to slidably displace corresponding lobes on the at least one slip, the flexible slip actuator having a passive mode and a reinforced mode that enables displacement of the at least one slip to a deployed position;

a rigid back-up sleeve received on the reduced diameter portion of the mandrel distal to and axially aligned with the bore of the flexible slip actuator which, in the running position, surrounds the larger diameter portion of the mandrel, the back-up sleeve axially movable with the mandrel between a running position, axially adjacent to the bore of the flexible slip actuator, and a reinforcing position with the larger diameter portion of the mandrel removed from the bore of the flexible slip actuator and the back-up sleeve received into the bore of the slip actuator to reinforce the slip actuator against radially inwardly collapse;

coupling a collet cage having a bore and a radially inwardly facing recess therein to a distal end of the slide member;

a collet having a bore surrounded by a plurality of angularly spaced and longitudinal collet fingers disposed into the bore of the collet cage, each of the collet fingers of the collet coupled at a proximal end to a proximal collet ring, each of the collet fingers coupled at a distal end to a distal collet ring, and one or more of the fingers having a radially outwardly projecting ridge disposed on a radially outwardly disposed face of the one or more fingers of the collet, wherein the collet in the collet cage in the running configuration is axially spaced apart from a distal stop on the mandrel a distance corresponding to an axial displacement distance to move the back-up sleeve from the running position axially adjacent to the bore of the flexible slip actuator to an enabled position within the bore of the reinforced slip actuator, and with the one or more projecting ridge of the collet releasably received in a seated position in the recess in the bore of the collet cage and requiring a predeterminable amount of axial displacement force to unseat the collet to move in a proximal direction relative to the collet cage;

the rotary cutting tool coupled to the distal connector of the mandrel and spaced apart from the slide member;

wherein displacement of the collet from the seated position within the collet cage enables further movement of the mandrel, the back-up sleeve and the reinforced slip actuator in a proximal direction within the slide member to deploy the at least one slip to the deployed position;

wherein rotation of the tubular string and the mandrel with the gripping tool positioned within the section of casing targeted for removal releases the mandrel from the running position within the slide member;

wherein displacement of the released mandrel and the back-up sleeve on the reduced diameter portion of the mandrel in the proximal direction within the bore of the slide member from the running position, with the back-up sleeve disposed axially adjacent the bore of the slip actuator, to the enabled position with the back-up sleeve received into the bore of the slip actuator, reinforces the slip actuator and enables deployment of the at least one slip to grip the casing;

wherein pulling the tubular string connected to the proximal connector of the mandrel into tension with the back-up sleeve in the enabled position further displaces the mandrel in the proximal direction relative to the slide member and displaces the back-up sleeve and the reinforced flexible slip actuator together in the proximal direction relative to the slide member to deploy the at least one slip radially outwardly through the at least one window in the slip cage;

wherein the mandrel is rotatable within the back-up sleeve with the tool in a gripping mode to operate the rotary cutting tool to cut the casing as the slide member, the at least one slip, the reinforced slip actuator and the back-up sleeve remain stationary and lodged in gripping engagement with the section of casing;

wherein upon completion of a successful cut the gripping tool can be withdrawn from the well with the detached casing section;

wherein the at least one spring biased friction member provides frictional resistance to axial movement of the slide member of the gripping tool to enable insertion of the back-up sleeve on the mandrel into the bore of the slip actuator coupled to the slide member; and wherein the gripping tool can be restored from the gripping mode to the running configuration by displacing the mandrel in a distal direction relative to the slide member to displace the back-up sleeve from the correspondingly tapered bore of the slip actuator.

8. The gripping tool of claim 7, wherein the at least one spring biased friction member provides frictional resistance to rotation of the slide member to enable threadable disengage of the mandrel from the slide member.

9. The gripping tool of claim 7, wherein the rigid back-up sleeve includes a frustoconical exterior taper with a smaller outer diameter leading end proximal to the bore of the flexible slip actuator and a larger diameter trailing end distal to the bore of the flexible slip actuator;

wherein the flexible slip actuator includes a bore that is correspondingly tapered to receive the frustoconical exterior taper of the back-up sleeve; and wherein the gripping tool can be restored from the gripping mode to the running configuration by displacing the mandrel in a distal direction relative to the slide member to more easily displace the back-up sleeve from the correspondingly tapered bore of the slip actuator.

10. The gripping tool of claim 7, further comprising:

at least one spring element disposed intermediate the slide member and the at least one slip to bias the at least one slip radially inwardly into the slip cage and towards the slip actuator and the mandrel of the gripping tool;

wherein the at least one spring element restores the at least one slip to the retracted position within the slip cage after displacement of the back-up sleeve to the running position axially adjacent to the bore of the flexible slip actuator.

11. The gripping tool of claim 7, wherein the slide member with at least one friction member disposed along an exterior surface of the slide member and at least one friction member spring element disposed intermediate the slide member and the at least one friction member comprises a plurality of angularly spaced friction members and a plurality of spring elements disposed intermediate each of the plurality of friction members and the slide member.

12. The gripping tool of claim 7, wherein the slip cage portion of the slide member comprises a plurality of angularly spaced windows through which a plurality of angularly spaced slips are deployable to engage and grip the interior wall of the casing.

* * * * *